United States Patent [19]

Endo et al.

[11] Patent Number: 4,520,096

[45] Date of Patent: May 28, 1985

[54] PHOTOGRAPHIC ELEMENTS FOR SILVER SALT DIFFUSION TRANSFER PROCESS CONTAINING MERCAPTO IMIDAZOLE STABILIZERS

[75] Inventors: Katsusuke Endo; Yoshio Inagaki, both of Kanagawa, Japan

[73] Assignee: Fuji Photo Film Co., Ltd., Japan

[21] Appl. No.: 620,204

[22] Filed: Jun. 13, 1984

[30] Foreign Application Priority Data

Jun. 14, 1983 [JP] Japan ..... 58-106464

[51] Int. Cl.[3] ..... G03C 5/54; G03C 1/35

[52] U.S. Cl. ..... 430/233; 430/248; 430/428; 430/611; 430/965

[58] Field of Search ..... 430/233, 248, 428, 611, 430/965

[56] References Cited

U.S. PATENT DOCUMENTS

| | | | |
|---|---|---|---|
| 3,252,799 | 5/1966 | Gotze et al. | 430/611 |
| 3,698,900 | 10/1972 | Johnson | 430/248 |
| 3,833,372 | 9/1974 | Hayashi et al. | 430/248 |
| 3,963,495 | 6/1976 | Kato et al. | 430/233 |

*Primary Examiner*—Richard L. Schilling
*Attorney, Agent, or Firm*—Sughrue, Mion, Zinn, Macpeak, and Seas

[57] ABSTRACT

A photographic element for a silver salt diffusion transfer process is described, comprising a silver halide light-sensitive element, an image receiving element and a processing element, the improvement wherein said photographic element contains a compound represented by formula (I) or (II)

(I)

(II)

wherein the $R_O$s, which may be identical or different from one another each represents hydrogen, a halogen atom, an alkyl group, a substituted alkyl group, a substituted or unsubstituted cycloalkyl group, an alkoxy group, a substituted alkoxy group, a substituted or unsubstituted alkylsulfonyl group, a substituted or unsubstituted arylsulfonyl group, a sulfamoyl group, an alkyl or arylsulfonamido group, a carbamoyl group, a carbonamido group, a heterocyclic group, a substituted or unsubstituted aryl group, an acyl group, a substituted or unsubstituted alkoxycarbonyl group, a substituted or unsubstituted acyloxy group, a substituted or unsubstituted alkylthio group, a substituted or unsubstituted arylthio group, a primary amino group or a salt thereof, a secondary or tertiary amino group substituted by alkyl groups or aryl groups or the salt thereof, a nitro group, a hydroxyl group, a carboxyl group, a sulfonic acid group or a cyano group; $R_1$ and $R_2$ each represents hydrogen, an alkyl group, a substituted alkyl group or an aryl group; $R_3$ and $R_4$ each represents hydrogen, an alkyl group, a substituted alkyl group, an aryl group, a substituted aryl group or a heterocyclic group; $R_3$ and $R_4$ may form a 5- or 6-membered ring together with the nitrogen atom, wherein the ring may further contain hetero atoms; $R_5$ and $R_6$ each represents hydrogen, an alkyl group, a substituted alkyl group, an aryl group, a substituted aryl group or a heterocyclic group; $A_1$ represents a divalent group; m represents an integer of 1 to 4; and n represents 1 or 2.

20 Claims, No Drawings

PHOTOGRAPHIC ELEMENTS FOR SILVER SALT DIFFUSION TRANSFER PROCESS CONTAINING MERCAPTO IMIDAZOLE STABILIZERS

FIELD OF THE INVENTION

The present invention relates to photographic elements used for a silver salt diffusion transfer process.

BACKGROUND OF THE INVENTION

A diffusion transfer process utilizing silver salts such as silver halide, etc., has been known. In such a photographic process, it is known that positive silver images are obtained directly on an image receiving element by putting a light-sensitive element containing exposed silver halide photographic emulsion on an image receiving element containing silver precipitants and processing in the presence of a developing agent by applying an alkaline processing solution containing a silver halide solvent between these two elements.

According to this process, unexposed silver halide emulsion in the light-sensitive element is dissolved by the silver halide solvent to come into the alkaline processing solution as a silver ion complex, which is transferred to the image receiving element, wherein it precipitates as silver images by the action of silver precipitants, and, consequently, direct positive images are formed.

The image receiving element used in this process is generally produced by providing an image receiving layer which contains silver precipitants selected from metal sulfides such as nickel sulfide, silver sulfide or palladium sulfide, etc., and noble metal colloids such as gold, silver, palladium, etc., in an alkali permeable polymer binder selected from gelatin, carboxymethyl cellulose, hydroxyethyl cellulose, regenerated cellulose, polyvinyl alcohol, sodium alginate, starch, gum arabic and colloidal silica, etc., on a paper support such as baryta paper, polyethylene laminated paper, lacquer paper or synthetic paper, etc., or a film support such as acetyl cellulose, polyethylene terephthalate or polystyrene film, etc.

In order to improve the image receiving elements, numberous inventions have been made. Particularly, it has been known to use regenerated cellulose as a binder in the image receiving layer.

Specifically, in U.S. Pat. No. 3,179,517, a process has been described for producing image receiving elements which comprises forming regenerated cellulose by hydrolyzing an acetyl cellulose film with alkali, and thereafter immersing the regenerated cellulose layer in a solution of a gold salt and a solution of a reducing agent to cause a reaction in the layer, whereby silver precipitant of gold colloid are formed. Further, in Japanese Patent Publication No. 32754/69, it has been described to produce an image receiving element by a process which comprises incorporating silver precipitant in an alkali impermeable polymer substance by vacuum deposition, dissolving it in a solvent which dissolves the polymer substance, applying the resulting solution to a support, drying and hydrolyzing the surface layer of the formed polymer layer so as to have an alkali permeable property.

Further, in Japanese Patent Publication No. 43944/71, it has been described to produce an image receiving element by a process which comprises forming silver precipitants in a solution of acetyl cellulose, applying it to a support and hydrolyzing acetyl cellulose to convert it into regenerated cellulose.

Furthermore, in Japanese Patent Publication No. 49411/76, it has been described to prepare an image receiving element by a process which comprises hydrolyzing a cellulose ester layer and incorporating silver precipitants in the hydrolyzed layer simultaneously with or after carried out hydrolysis.

Moreover, in U.S. Pat. No. 4,163,816, production of an image receiving element has been described by a process which comprises hydrolyzing acetyl cellulose in a solution with an acid to convert it into acetyl cellulose having a low degree of acetylation, and applying the solution to a support.

However, silver images formed on the image receiving elements obtained as described above have a fault in that they easily discolor or fade during preservation.

As a process for improving the above-described fault, it has been described in Japanese Patent Publication No. 5392/71, U.S. Pat. No. 3,533,789 and British Pat. No. 1,164,642 to apply a water soluble polymer solution containing an alkali neutralizing component to the surface of the resulting silver images. However, according to this process, the surface to which the aqueous solution of the polymer is applied requires a long time for complete drying. Therefore, it is impossible to arrange the prints in layers while drying, because the surface is sticky, and thus fingerprints and dust often adhere to the surface. Further, application of such a solution to the silver images is troublesome.

Japanese Patent Publication No. 44418/81 has disclosed image receiving elements comprising a support, (I) a hydrolyzable cellulose ester, polyvinyl ester or polyvinyl acetal layer containing a diffusible compound capable of changing properties of silver images, which becomes to have an alkali permeable property by hydrolysis, provided on the support, and (II) a regenerated cellulose layer containing silver precipitants provided on said layer. As the diffusible compounds capable of changing properties of silver images, organic mercapto compounds have been described. In this case, the diffusion transfer processing solution and the mercapto compound in layer I gradually diffuse into layer II and protect silver images formed in layer II, whereby discoloration and fading can be prevented.

In order to completely exhibit the effect of preventing discoloration and fading, it is necessary that the mercapto compound has sufficient ability of preventing discoloration and fading and it remains in layer I during preservation of the undeveloped image receiving element or during diffusion transfer processing, but it permeates into layer II from layer I after formation of silver images by the diffusion transfer processing to protect the images formed on the layer II. If the mercapto compound diffuses into the layer II from the layer I before conclusion of the diffusion transfer processing, development is restricted and optical densities of the transfer silver images on image receiving material deteriorate on the whole. Further, if diffusion of the mercapto compound is retarded too much, discoloration or fading of images occurs before the silver images are protected by the mercapto compound.

However, mercapto compounds described in Japanese Patent Publication No. 44418/81 have faults, in that they have insufficient ability of preventing discoloration and fading and cause discoloration or fading of images, and further they restrain development by diffusing into the layer II from the layer I during preservation of the undeveloped image receiving element to deteriorate optical densities of the transfer silver images.

Further, Japanese Patent Application (OPI) No. 120634/74 has disclosed image receiving elements which are produced with using homopolymers, copolymers and graft polymers of monoacrylate or monomethacrylate of polyhydric alcohols as a polymer layer containing a compound which changes properties of silver images.

However, compounds described in Japanese Patent Application (OPI) No. 120634/74 have faults similar to those of compounds described in Japanese Patent Publication No. 4418/81, that they have insufficient ability of preventing discoloration or fading of images and they cause decrease of optical densities of transfer silver images.

Further, British Pat. No. 1,276,961 has disclosed that 2-mercapto-1,3,4-triazole derivatives are used for obtaining stable silver images by the diffusion transfer process. Moreover, U.S. Pat. No. 3,655,380 has disclosed that 5-seleno-1,2,3,4-tetrazole derivatives improve the tone of silver images obtained by the diffusion transfer process so as to be neutral gray and they give stable silver images.

However, these compounds have a fault in that the effect of stabilizing silver images obtained by the diffusion transfer process is insufficient to cause discoloration or fading of images. Therefore, it has been desired to provide compounds having a good effect of stabilizing silver images.

SUMMARY OF THE INVENTION

An object of the present invention is to provide novel photographic elements for diffusion transfer process.

Another object of the present invention is to provide novel image receiving elements for diffusion transfer process.

A further object of the present invention is to provide an image receiving element for diffusion transfer process, the performance of which does not change during preservation before development processing.

A further object of the present invention is to provide image receiving elements for forming stable silver images by a diffusion transfer process.

A furthermore object of the present invention is to provide novel image stabilizers.

The above-described objects of the present invention have been attained by providing photographic elements for silver salt diffusion transfer process comprising a silver halide light-sensitive element, an image receiving element and a processing element, wherein said photographic elements contain a compound represented by formula (I) or (II).

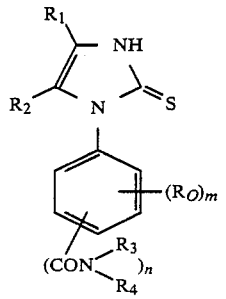

(I)

-continued

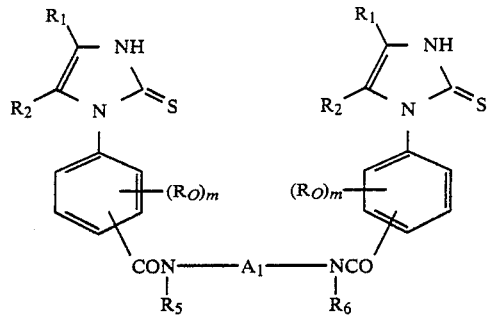

(II)

In formulae (I) and (II), $R_O$s, which may be identical or different from one another, each represents hydrogen, a halogen atom (for example, F, Cl, or Br), an alkyl group, preferably, an alkyl group having 1 to 14 carbon atoms (for example, a methyl group or an ethyl group), a substituted alkyl group, preferably, a substituted alkyl group having 1 to 14 carbon atoms in the alkyl moiety, a substituted or unsubstituted cycloalkyl group having, preferably, 3 to 14 carbon atoms, an alkoxy group having, preferably, 1 to 14 carbon atoms, a substituted alkoxy group having, preferably, 1 to 14 carbon atoms (for example, a methoxy group or an ethoxy group), a substituted or unsubstituted alkylsulfonyl group having, preferably, 1 to 14 carbon atoms, a substituted or unsubstituted arylsulfonyl group having, preferably, 6 to 14 carbon atoms, a sulfamoyl group (the nitrogen atom of said sulfamoyl group may be substituted by alkyl groups having 14 or less carbon atoms, substituted alkyl groups, cycloalkyl groups, substituted cycloalkyl groups, aryl groups, substituted aryl groups and substituted or unsubstituted 5- to 7-membered heterocyclic groups containing one or more of at least one kind of a nitrogen atom, an oxygen atom and a sulfur atom, or two substituents on the nitrogen atoms may form a ring by linking together), an alkyl or arylsulfonamido group (wherein the alkyl moiety or the aryl moiety may have substituents, and the nitrogen atom of said sulfonamido group may be substituted by alkyl groups having 14 or less carbon atoms, substituted alkyl groups, cycloalkyl groups, substituted cycloalkyl groups, aryl groups, substituted aryl groups and substituted or unsubstituted 5- to 7-membered heterocyclic groups containing one or more of at least one kind of a nitrogen atom, an oxygen atom and a sulfur atom), a carbamoyl group (wherein the nitrogen atom of said carbamoyl group may be substituted by alkyl groups having 14 or less carbon atoms, substituted alkyl groups, cycloalkyl groups, substituted cycloalkyl groups, aryl groups, substituted aryl groups, and substituted or unsubstituted 5- to 7-membered heterocyclic groups containing one or more of at least one kind of a nitrogen atom, an oxygen atom and a sulfur atom, or two substituents on the nitrogen atoms may form a ring by linking together), a carbonamido group (wherein the nitrogen atom of said carbonamido group may be substituted by alkyl groups having 14 or less carbon atoms, substituted alkyl groups, cycloalkyl groups, substituted cycloalkyl groups, aryl groups, substituted aryl groups and substituted or unsubstituted 5- to 7-membered heterocyclic groups containing one or more of at least one kind of a nitrogen atom, an oxygen atom and a sulfur atom), a heterocyclic group, preferably, a substituted or unsubstituted 5- to 7-membered heterocyclic group containing one or more of at least one kind of a nitrogen atom, an oxygen atom and a sulfur atom, a substituted or unsubstituted aryl group having, preferably, 14 or less carbon atoms, an acyl group having, preferably, 14 or less carbon atoms, a substituted or unsubstituted alkoxycarbonyl group having, preferably, 2 to 14 carbon atoms, a substituted or unsubstituted acyloxy group having, preferably, 2 to 14 carbon atoms, a substituted or unsubstituted alkylthio group having, preferably, 1 to 14 carbon atoms, a substituted or unsubstituted arylthio group having, preferably, 6 to 14 carbon atoms, a primary amino group or the salt thereof, a secondary or tertiary amino group substituted by alkyl groups having 1 to 14 carbon atoms or aryl groups having 6 to 14 carbon atoms or the salt thereof, wherein the alkyl groups and the aryl groups may have substituents, a nitro group, a hydroxyl group, a carboxyl group, a sulfonic acid group or a cyano group, and $R_1$ and $R_2$ each represents hydrogen, an alkyl group having, preferably, 1 to 14 carbon atoms (for example, a methyl group or an ethyl group), a substituted alkyl group having, preferably, 1 to 14 carbon atoms in the alkyl moiety (for example, a methoxyethyl group, an ethoxyethyl group, a chloroethyl group or a benzyl group) or an aryl group (for example, a phenyl group or a naphthyl group).

$R_3$ and $R_4$ each represents hydrogen, an alkyl group having, preferably, 1 to 14 carbon atoms (for example, a butyl group, a hexyl group or an octyl group), a substituted alkyl group having, preferably, 1 to 14 carbon atoms in the alkyl moiety (for example, a methoxy group, a benzyl group or a hydroxyethyl group), an aryl group (for example, a phenyl group or a naphthyl group), a substituted aryl group, or a heterocyclic group, preferably, a substituted or unsubstituted 5- to 7-membered heterocyclic group having one or more of at least one kind of a nitrogen atom, an oxygen atom and a sulfur atom, and $R_3$ and $R_4$ may form a 5- to 6-membered ring together with the N atom (for example, a piperidine ring or a morpholine ring) wherein the ring may further contain hetero atoms.

$R_5$ and $R_6$ each represents hydrogen, an alkyl group having, preferably 1 to 6 carbon atoms (for example, a methyl group or an ethyl group), a substituted alkyl group having, preferably, 1 to 6 carbon atoms in the alkyl moiety (for example, a methoxyethyl group, a hydroxyethyl group or a benzyl group), an aryl group (for example, a phenyl group), a substituted aryl group, or a heterocyclic group, preferably, a substituted or unsubstituted 5- to 7-membered heterocyclic group containing one or more of at least one kind of a nitrogen atom, an oxygen atom, and a sulfur atom.

Examples of substituents in the substituted alkyl group represented by $R_1$ or $R_2$ include alkoxy groups (for example, a methoxy group and an ethoxy group), halogen atoms (for example, Cl and Br) and a phenyl group.

Examples of substituents in the substituted alkyl groups represented by $R_3$ to $R_6$ include alkoxy groups (for example, a methoxy group and an ethoxy group), halogen atoms (for example, Cl and Br), a phenyl group and a hydroxyl group, etc.

Examples of substituents in the substituted aryl groups represented by $R_3$ to $R_6$ include alkyl groups (for example, a methyl group and an ethyl group), alkoxy groups (a methoxy group and an ethoxy group) and halogen atoms (Cl and Br), etc.

$A_1$ represents a divalent group. Examples of preferable divalent group include the following.

$$-(CH_2)_{n1}O-(CH_2)_{n1}$$

wherein n1 is an integer of 1 to 6, $$-(CH_2)_{n2}$$

wherein n2 is an integer of 2 to 12,

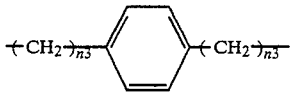

wherein n3 is 0 or an integer of 1 to 4, and $$-(CH_2)_{n4}A_2-(CH_2)_{n4}$$

wherein n4 is an integer of 1 to 6 and $A_2$ is

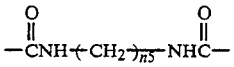

(wherein n5 is an integer of 2 to 10).

m represents an integer of 1 to 4, and n represents 1 or 2.

DETAILED DESCRIPTION OF THE INVENTION

The alkyl groups and the alkyl moieties represented by $R_1$ to $R_6$ may be straight chain or branched chain.

In the above-described formula (I), it is preferred that $R_1$, $R_2$, and $R_4$ each represents hydrogen, m is 0, n is 1 and $R_3$ represents an alkyl group having 4 to 14 carbon atoms or a substituted alkyl group having 4 to 14 carbon atoms in the alkyl moiety.

In the above-described formula (II), it is preferred that $R_1$, $R_2$, $R_5$ and $R_6$ each represents hydrogen, m is O and $A_1$ represents an alkylene group having 2 to 8 carbon atoms. It is particularly preferred that $A_1$ represents an ethylene group, a propylene group, a butylene group, a pentylene group, a heptylene group or an octylene group.

Preferably, the above-described objects are attained by incorporating the compound represented by the above-described formula (I) or (II) in a photographic element for a silver salt diffusion transfer process, wherein the diffusion transfer processing is carried out by putting an imagewise exposed silver halide light-sensitive element on an image receiving element containing silver precipitants and spreading an alkaline processing composition between them.

More preferred embodiments are those wherein the compound represented by formula (I) or (II) is contained in the above described image receiving element.

As the photographic elements for a silver salt diffusion transfer process containing the compound represented by the general formula (I) or (II), it is preferred to use those wherein transfer silver images are obtained by putting a light-sensitive material wherein a light-sensitive element containing a silver halide photographic emulsion is applied to a support on an image receiving material wherein an image receiving element containing silver precipitants is applied to another support, and spreading an alkaline processing composition as a processing element between the above-described light-sensitive material and the image receiving material.

It is preferred that the support for supporting the above-described image receiving element is a polyethylene laminated paper.

The image receiving element is preferred to have an acid polymer layer which reduces the pH of the image receiving element after development processing and the so-called neutralization timing layer which controls timing of neutralization.

The neutralization timing layer is preferred to contain acetyl cellulose.

The image receiving element is preferred to have a layer construction wherein an acid polymer layer, a neutralization timing layer and an image receiving layer containing silver precipitants are applied to a support in this order. In the above-described layer construction, it is particularly preferred to provide a hydrophilic polymer layer between the neutralization timing layer and the image receiving layer.

It is preferred that the compound represented by formula (I) or (II) is added to a layer excepting the image receiving layer.

The image receiving element is preferred to contain the compound represented by the formula (I) or (II) and a water soluble heavy metal salt (preferably, chloroaurate).

In the following, examples of effective compounds represented by formulae (I) and (II) are described, but the present invention is not limited to these compounds.

1.

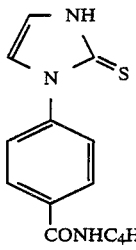

2.

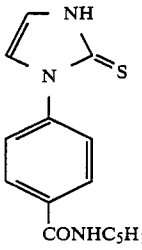

3.

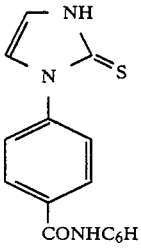

-continued

4.

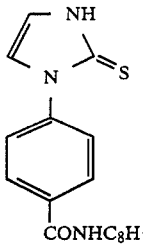

5.

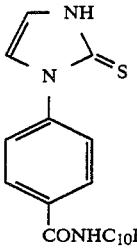

6.

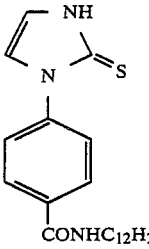

7.

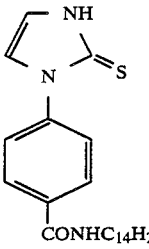

8.

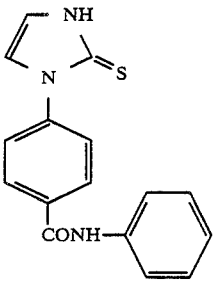

9.

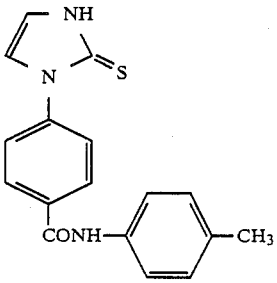

-continued
10.
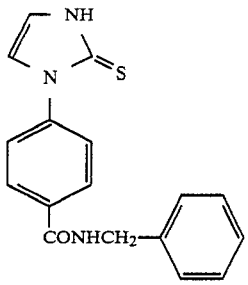
11.
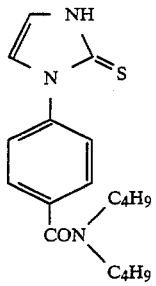
12.
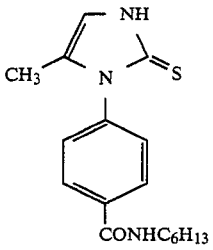
13.
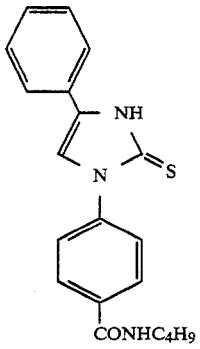
14.
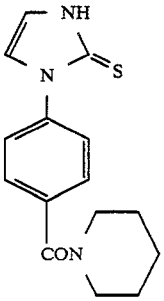
-continued
15.
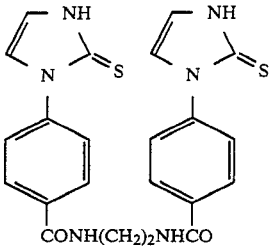
16.
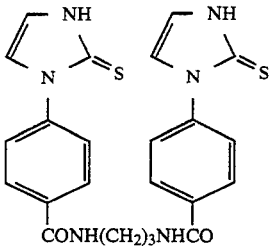
17.
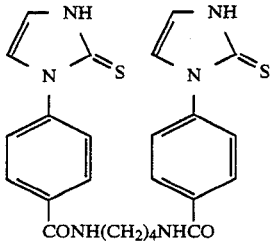
18.
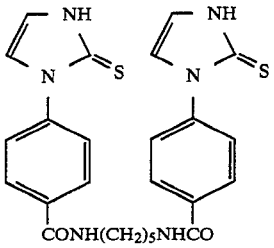
19.
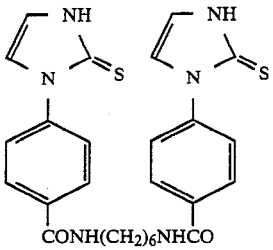
20.
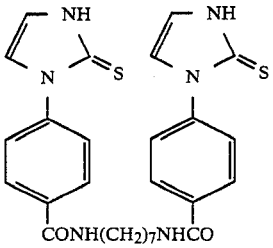

-continued
21.
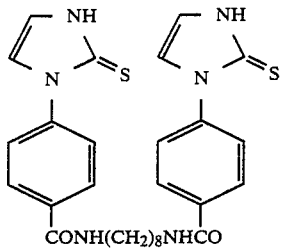
22.
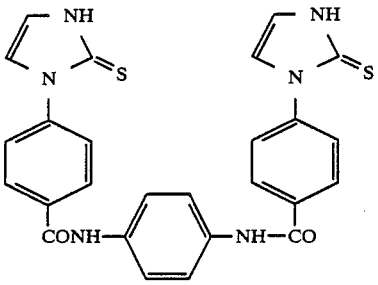
23.
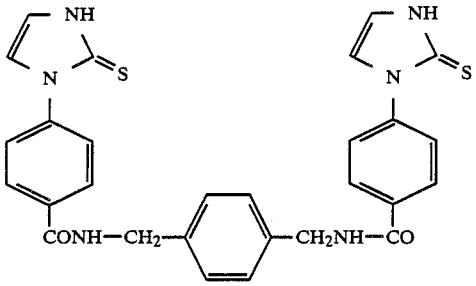
24.
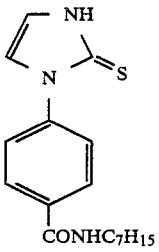
25.
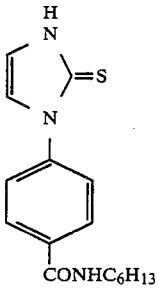
26.
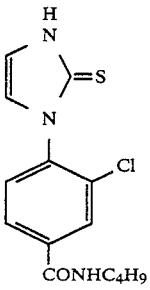
-continued
27.
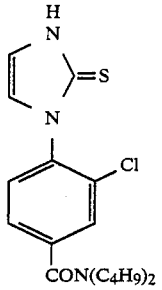
28.
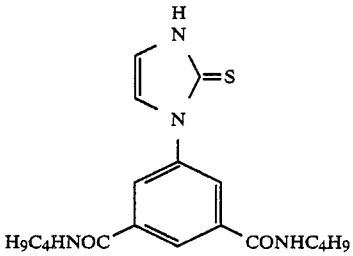
29.
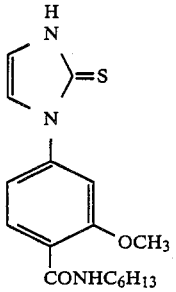
30.
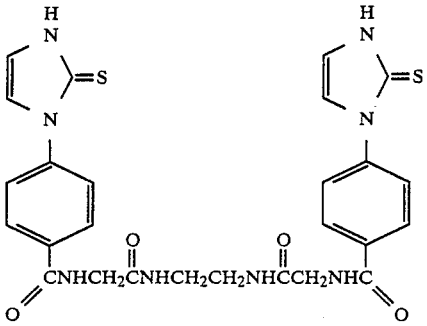
31.
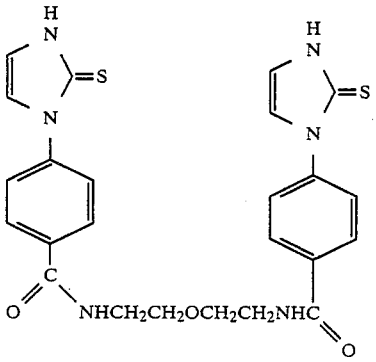

-continued

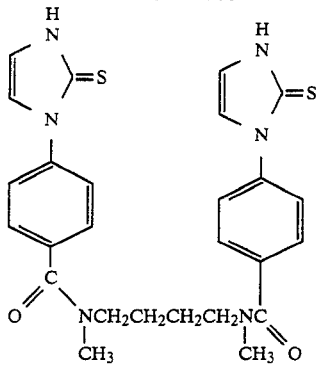

32.

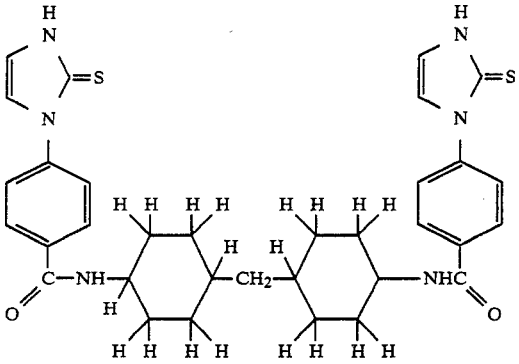

33.

-continued

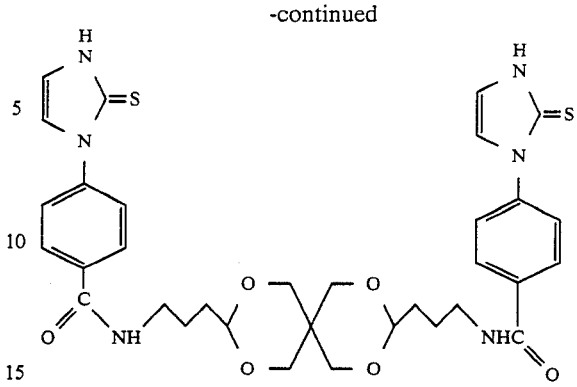

34.

The compounds used according to the present invention can be synthesized by conventional processes.

More specifically, the compounds used in the present invention are obtained by reacting a carboxylic acid represented by the formula (A) with a chlorinating agent such as thionyl chloride, phosphorus oxychloride, etc., in a solvent such as acetonitrile, dimethylformamide, dimethylacetamide, N-methylpyrrolidone, etc., to convert it into a corresponding carboxylic acid chloride represented by the formula (B), and thereafter reacting the resulting product with an amine. Alternatively, the compounds used in the present invention can be obtained by reacting a carboxylic acid represented by the formula (A) with a chloroformic acid ester such as isobutyl chloroformate, ethyl chloroformate, methyl chloroformate, etc., in a solvent such as N,N-dimethylformamide, N,N-dimethylacetamide, N-methylpyrrolidone, etc., to convert it into a corresponding mixed acid anhydride represented by the formula (C), and reacting the resulting product with an amine. These processes are illustrated below.

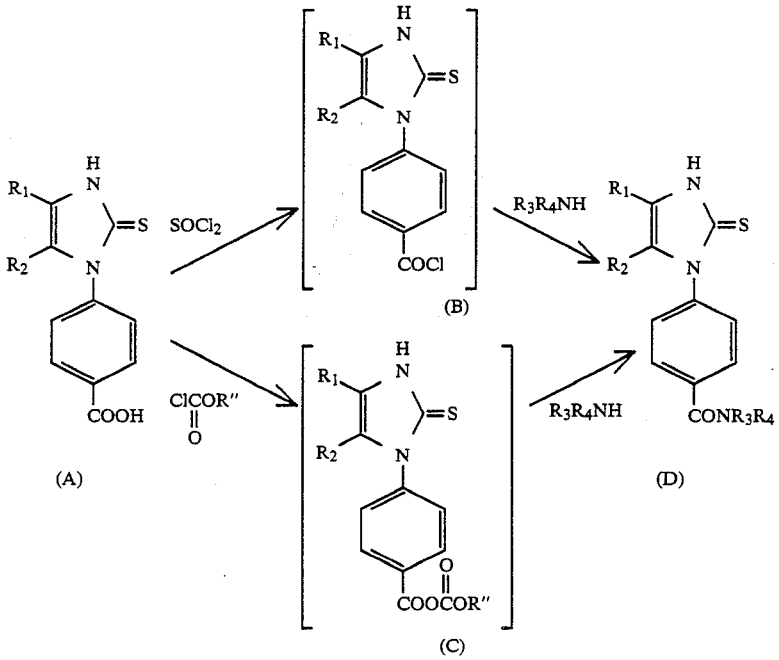

If diamines such as alkylenediamines, etc., are used as the amines in an amount of ½ molar equivalents of the carboxylic acid (A), compounds represented by the formula (E) are obtained.

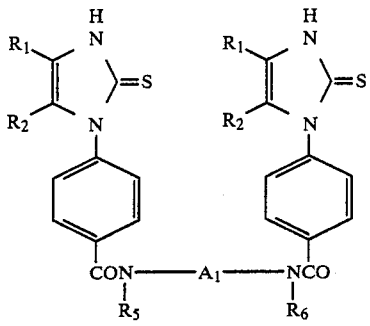

(E)

Examples of these synthesis reactions are described hereinafter. Conventional synthetic operations and matters to be attended to in these kinds of amide synthetic processes and analogous synthesis examples have been described, for example, in *Organic Functional Group Preparations,* written by S. R. Sandler and W. Karo, published by Academic Press, 1968, pages 124–127 and 274–286, and *Peptide Gosei,* written by Nobuo Izumiya, Tetsuo Kato, Motonori Ono and Tohiko Aoyagi, published by Maruzen Co., 1975, pages 115–153; such synthetic processes can be utilized for synthesizing the compounds the present invention.

Further, carboxylic acids represented by the formula (A) can be synthesized from p-aminobenzoic acid esters (for example, ethyl esters) by the following procedure. Namely, a p-aminobenzoic acid ester is processed with carbon disulfide and triethylamine to produce a corresponding dithiocarbamic acid triethylammonium salt. It is then allowed to react with ethyl chloroformate or methyl chloroformate, followed by heating to obtain a corresponding isothiocyanate. To the isothiocyanate, aminoacetaldehyde diethyl acetal is added, and the mixed product is heated in the presence of an acid, by which the ester is hydrolyzed simultaneously with ring-closing to obtain a carboxylic acid represented by the formula (A). Substituted derivatives of the compounds represented by the formula (A) can be synthesized by the same process as described above.

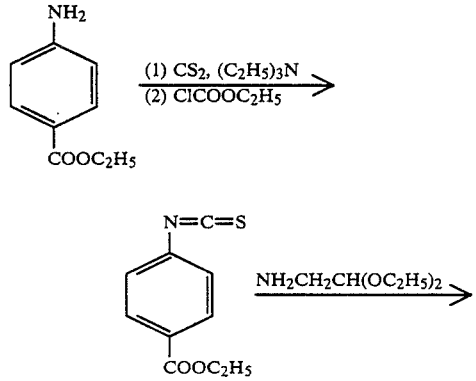

(A)

-continued

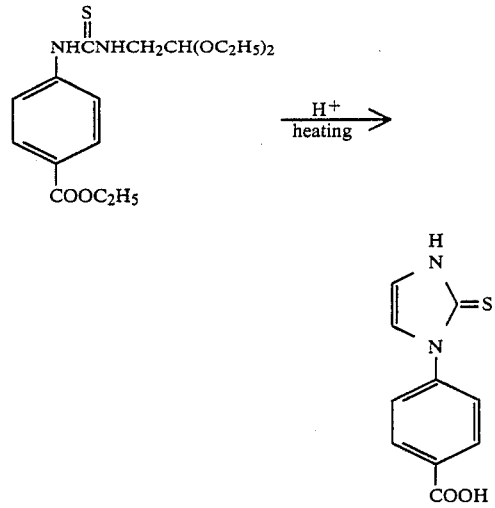

The isothiocyanates used (for example, p-carboethoxyphenyl-isothiocyanate) can be synthesized according to the process described in *Organic Functional Group Preparations,* written by S. R. Sandler and W. Karo, published by Academic Press, 1968; pages 312–315.

In the following, processes for synthesizing compounds of the present invention are illustrated by synthesis examples, and compounds which are not shown in the synthesis examples can be synthesized according to the following synthesis examples.

SYNTHESIS EXAMPLE 1

Synthesis of Compound 3

(1) Synthesis of N-(4-carboethoxyphenyl)-N'-(2,2-diethoxyethyl)thiourea:

20 g of 4-carboethoxyphenylisothiocyanate was dissolved in 50 ml of carbon tetrachloride, and 13 g of aminoacetaldehyde diethyl acetal was added dropwise to the resulted solution over 5 minutes. The mixture was then stirred at room temperature for 1 hour. 50 ml of carbon tetrachloride was added to the reaction mixture, and the precipitated crystals were filtered off, washed with 50 ml of carbon tetrachloride and dried. Yield: 27.5 g and 80.9%.

(2) Synthesis of carboxylic acid (A) (1-(4-carboxyphenyl)-2,3-dihydroimidazol-2-thione)):

To 80 g of N-(4-carboethoxyphenyl)-N'-(2,2-diethoxyethyl)thiourea obtained in (1), 400 ml of 30% sulfuric acid was added and the mixture was refluxed on an oil bath for 1 hour. After the reaction mixture was cooled to room temperature, 600 ml of water was added and the mixture was cooled with ice. The separated crystals were filtered off, washed with 200 ml of water, 100 ml of isopropyl alcohol and 100 ml of hexane in turns, and dried. Yield: 48 g and 92.8%.

(3) Synthesis of Compound 3:

26.4 g of 1-(4-carboxyphenyl)-2,3-dihydroimidazole-2-thione obtained in (2) was dissolved in 200 ml of N,N-dimethylformamide, and the resulted solution was cooled to a liquid temperature of −5° C. to −15° C. To the resulted solution, 15.6 ml of isobutyl chloroformate was added dropwise with keeping the liquid temperature in a range of −5° C. to −15° C. After 16.8 ml of triethylamine was added dropwise with keeping the liquid temperature in a range of from −5° C. to −15° C., the mixture was further stirred for 10 minutes. After 12.0 g of hexylamine was added dropwise while maintaining the liquid temperature in a range of from −5° C. to −10° C., the mixture was further stirred for 30 minutes. After stirred at room temperature for 2 hours, a solution prepared by dissolving 20 g of sodium hydrogen carbonate in 1 l of water was added, and the precipitated crystals were filtered off and washed with water. The crude crystals were recrystallized from a 2:1 (ratio by volume) mixture of methanol and water, followed by drying. Yield: 20.9 g, 57.5%. Melting point: 194°–196° C.

SYNTHESIS EXAMPLE 2

Synthesis of Compound 1

Compound 1 was obtained in the same manner as in Synthesis Example 1, except that 8.8 g of butylamine was used in place of 12 g of hexylamine. Yield: 6.4 g and 19.4%. Melting point: 196°–198° C.

SYNTHESIS EXAMPLE 3

Synthesis of Compound 4

Compound 4 was obtained in the same manner as in Synthesis Example 1, except that 15.4 g of octylamine was used in place of 12 g of hexylamine. Yield: 27.6 g and 69.5%. Melting point: 202°–204° C.

SYNTHESIS EXAMPLE 4

Synthesis of Compound 5

Compound 5 was obtained in the same manner as in Synthesis Example 1, except that 18.8 g of decylamine was used in place of 12.0 g of hexylamine. Yield: 26.8 g and 62.0%. Melting point: 210°–212° C.

SYNTHESIS EXAMPLE 5

Synthesis of Compound 6

Compound 6 was obtained in the same manner as in Synthesis Example 1, except that 22.2 g of dodecylamine was used in place of 12.0 g of hexylamine and methanol was used as a solvent for recrystallization. Yield: 20.8 g and 44.7%. Melting point: 209°–211° C.

SYNTHESIS EXAMPLE 6

Synthesis of Compound 7

Compound 7 was obtained in the same manner as in Synthesis Example 1, except that 17.6 g of tetradecylamine was added in place of 12.0 g of hexylamine and methanol was used as a solvent for recrystallization. Yield: 20.4 g and 40.9%. Melting point: 211°–212° C.

SYNTHESIS EXAMPLE 7

Synthesis of Compound 18

Compound 18 was obtained in the same manner as in Synthesis Example 1, except that 6.7 g of 1,5-diaminopentane was used in place of 12 g of hexylamine and the crude crystals were recrystallized from methanol. Melting point: 304°–306° C.

SYNTHESIS EXAMPLE 8

Synthesis of Compound 20

Compound 20 was obtained in the same manner as in Synthesis Example 1, except that 8.6 g of 1,7-diaminoheptane was used in place of 12 g of hexylamine and the crude crystals were recrystallized from methanol. Melting point: 228°–230° C.

SYNTHESIS EXAMPLE 9

Synthesis of Compound 16

Compound 16 was obtained in the same manner as in Synthesis Example 1, except that 4.4 g of 1,3-diaminopropane was used in place of 12 g of hexylamine, and the crude crystals were crystallized by adding methanol after dissolved in N,N-dimethylformamide, Melting point: 266°–270° C.

SYNTHESIS EXAMPLE 10

Synthesis of Compound 21

Compound 21 was obtained in the same manner as in Synthesis Example 9, except that 8.6 g of 1,8-diaminooctane was used in place of 4.4 g of 1,3-diaminopropane. Melting point: above 300° C.

The image stabilizing agent represented by the above-described formula (I) or (II) can be incorporated in any of the light-sensitive element, the image receiving element, and the processing element. Further, it may be incorporated in two or more of these elements. However, it is particularly preferably incorporated in the image receiving element.

The diffusion transfer process is well known in the field of this art. Details there of described, e.g., in A. Rott and E. Weyde, *Photographic Silver Diffusion Transfer Processes* Focal Press, London, 1972; C. B. Neblette, *Hand book of Photographic and Reprography,* 7th ed., Van Nostrand Reinhold, (1977) Chapter 12, One-Step Photography; and Haist, *Modern Photographic Processing* Vol. 2, Chapter 8, Diffusion Transfer.

In the diffusion transfer process, many kinds of photographic materials can be used. Namely, it is known that transfer silver images can be obtained by laying a light-sensitive material which comprises a light-sensitive element containing a silver halide photographic emulsion applied to a support on an image receiving material which comprises an image receiving element containing silver precipitants applied to another support, and spreading an alkaline processing composition as a processing element, for example, an alkaline processing composition having a high or low viscosity which contains a developing agent and a solvent for silver halide between the above-described two elements. This type of photographic material is advantageously used for practicing the present invention.

In another known photographic material, a light-sensitive element and an image receiving element are applied to a support in layers by which positive images can be observed through negative images utilizing the high covering power of the positive images, as described in U.S. Pat. No. 2,861,885. As a further known photographic material, there is that which has the same construction as described above, wherein only positive images are obtained by washing off the layer of the light-sensitive material after carring out diffusion transfer processing.

Further, as another known photographic material, there is that which comprises a silver halide light-sensitive layer, a layer containing a light reflecting substance such as titanium white, and an image receiving layer containing silver precipitants applied to a support in turn, wherein positive images are obtained by processing.

Moreover, a photographic material has been known having an integral type structure wherein a light-sensitive element and an image receiving element are provided on the same support so as to use it without separating the image receiving element from the light-sensitive element after carrying out diffusion transfer processing.

Further, additive color images can be produced by forming silver transfer images according to the present invention, and these images have a superposed connection with an additive color screen. In such an example, additive color images can be suitably produced by placing an additive color screen between a transparent support and the above-described image receiving layer and exposing the silver halide emulsion to light through the screen.

These various kinds of photographic materials have been described in detail in A. Rott and E. Weyde, *Photographic Silver Diffusion Transfer Processes* Focal Press, London, 1972; C. B. Neblette, *Hand book of Photography and Reprography,* 7th ed., Van Nostrand Reinhold, (1977) Chapter 12, One-Step Photography, and Haist, *Modern Photographic Processing* Vol. 2, Chapter 8, Diffusion Transfer.

Although the present invention is applicable for all film units of the above-described photographic materials, the case wherein a light-sensitive element and an image receiving element are applied to different supports respectively, is illustrated in detail herein.

The light-sensitive layer used in the present invention may contain one or more kinds of silver halide. Examples of such silver halide include silver chloride, silver bromide, silver iodide and mixtures of them such as silver chlorobromide, silver chloroiodobromide and silver iodobromide. They may be incorporated by dispersing in suitable protective colloid substances, such as gelatin, agar, albumen, casein, collodion, cellulose type materials, for example, carboxymethyl cellulose, vinyl polymers, for example, polyvinyl alcohol, or linear polyamides, for example, polyhexamethylene adipamide. Emulsions suitable for such use can be prepared by processes described in *Chimie et Physique Photographique,* written by P. Glafkides (published by Paul Montel Co., 1967), *Photographic Emulsion Chemistry,* written by G. F. Duffin (published by The Focal Press, 1966), and *Making and Coating Photographic Emulsion,* written by V. L. Zelikman et al (published by The Focal Press, 1964), etc. Namely, any of an acid process, a neutral process and an ammonia process, etc. may be used. Further, as a type of reacting soluble silver salts with soluble halogen salts, any of a single jet mixing process, a double jet mixing process and the combination thereof may be used.

A process of forming grains in the presence of excess silver ion (the so-called reverse mixing process) can be used, too. As a type of double jet mixing process, a process which comprises keeping the pAg of a liquid phase where silver halide is formed at a constant value, namely, the so-called controlled double jet process, can be used, too.

As silver halide emulsions, though the so-called primitive emulsions which are not subjected to chemical sensitization can be used, they are generally chemically sensitized. In order to carry out chemical sensitization, it is possible to use processes described in the above-described literatures written by Glafkides, Duffin, and Zellikman et al, and *Grundlagen der Photographischern Prozesse mit Silberhalogenid-emulsionen,* edited by H. Frieser (Akademische Verlaggesellschaft, 1968).

The silver halide emulsion can be subjected, if desired to spectral sensitization of supersensitization by using one or more of cyanine dyes such as cyanine, merocyanine or carbocyanine dyes, or combinations of the cyanine dyes and styryl dyes. These color sensitization techniques have been well-known hitherto and they have been described, for example, in U.S. Pat. Nos. 2,493,748, 2,519,001, 2,688,545, 2,912,329, 2,977,229, 3,397,060, 3,480,434, 3,511,664, 3,522,052, 3,527,641, 3,615,613, 3,615,632, 3,617,295, 3,635,721, 3,694,217, 3,615,635, 3,628,964, 3,672,897, and 3,703,377, British Pat. Nos. 1,137,580, 1,195,302, 1,216,203, 1,242,588 1,293,862, etc., West German Patent Application (OLS) Nos. 2,030,326 and 2,121,780, and Japanese Patent Publication Nos. 4936/68, 14030/69 and 10773/68. Selection thereof can be suitably carried out according to the purpose and use of the light-sensitive materials, such as a wavelength range to be sensitized or sensitivity, etc.

Silver halide emulsions used in the present invention may contain antifoggants and stabilizers, such compounds as described in *Product Licensing Index,* Vol. 92, page 107, the paragraph entitled "Antifoggants and stabilizers".

The silver halide emulsions may contain developing agents, such as those described in *Product Licensing Index,* Vol. 92, pages 107–108, the paragraph entitled "Developing agents".

Silver halide can be dispersed in colloids capable of hardening by various organic or inorganic hardeners, such as the hardeners described in *Product Licensing Index,* Vol. 92, page 108, the paragraph entitled "Hardeners" can be used.

The silver halide emulsions may contain coating aids, such as those described in *Product Licensing Index,* Vol. 92, page 108, the paragraph entitled "Coating aids".

The silver halide photographic emulsions may contain antistatic agents, plasticizers, fluorescent whitening agents, anti-air-fogging agents and the like.

In the silver halide emulsions used in the present invention, vehicles as described in *Product Licensing Index,* Vol. 92, page 108, the paragraph entitled "Vehicles" (Dec. 1971) can be used.

The silver halide emulsions are applied to supports together with, if desired, other photographic layers. Application can be carried out by processes as described in *Product Licensing Index,* Vol. 92, page 109, the paragraph entitled "Coating Procedures". Further, as supports, those described in *Product Licensing Index,* Vol. 92, page 108, paragraph "Supports" can be used.

For the purpose of increasing sensitivity, improving contrast on accelerating development, the photographic emulsions of the present invention may contain, for example, polyalkylene oxides or derivatives thereof such as ethers, esters or amines thereof, thioether compounds, thiomorpholines, quaternary ammonium salt compounds, urethane derivatives, urea derivatives, imidazole derivatives and 3-pyrazolidones, etc. For example, it is possible to use compounds described in U.S. Pat. Nos. 2,400,532, 2,423,549, 2,716,062, 3,617,280, 3,772,021, 3,808,003, etc.

In the light-sensitive materials produced according to the present invention, the photographic emulsion layer and other hydrophilic colloid layers may contain water soluble dyes as filter dyes or for the purpose of preventing irradiation and others. Examples of such dyes include oxonol dyes, hemioxonol dyes, styryl dyes, merocyanine dyes, cyanine dyes and azo dyes. Among others, merocyanine dyes such as oxonol dyes and hemioxonol dyes are useful. The dyes may be mordanted by cationic polymers such as dialkylaminoalkyl acrylate, etc., in a specific layer.

In the light-sensitive materials produced according to the present invention, when dyes or ultraviolet ray absorbing agents are contained in hydrophilic colloid layers, they may be mordanted by cationic polymers. For example, it is possible to use polymers described in British Pat. No. 685,475, U.S. Pat. Nos. 2,675,316, 2,839,401, 2,882,156, 3,048,487, 3,184,309 and 3,445,231, German Patent Application (OLS) No. 1,914,362 and Japanese Patent Application (OPI) Nos. 47624/75 and 71332/75, etc.

As the processing element in the present invention, various processing compositions are used, but the processing compositions are preferred to contain a developing agent, a solvent for silver halide and an alkali agent. However, the developing agent and/or the solvent for silver halide may be incorporated in the light-sensitive element and/or the image receiving element according to the particular purpose.

Examples of suitable silver halide developing agents include benzene derivatives substituted by at least two hydroxyl and/or amino groups at ortho- or parapositions of the benzene ring, such as hydroquinone, amidol, metol, glycine, p-aminophenol and pyrogallol; and hydroxylamines, particularly, primary or secondary aliphatic or aromatic N-substituted or $\beta$-hydroxylamines which are soluble in aqueous alkalies, such as hydroxylamine, N-methylhydroxylamine or N-ethyl hydroxylamine and those described in U.S. Pat. No. 2,857,276 and Oct. 21, 1958 by Edwin H. Land et al and N-alkoxyalkyl substituted hydroxylamines described in U.S. Pat. No. 3,293,034 on Dec. 20, 1966 by Miltongreen et al.

Further, hydroxylamine derivatives having a tetrahydrofurfuryl group described in Japanese Patent Application (OPI) No. 88521/74 are used, too.

Further, aminoreductones described in West German Patent Application (OLS) Nos. 2,009,054, 2,009,055 and 2,009,078 and heterocyclic aminoreductones described in U.S. Pat. No. 4,128,425 are used, too.

Moreover, it is possible to use tetraalkyl reductic acids described in U.S. Pat. No. 3,615,440.

Further, it is possible to use auxiliary developing agents such as phenidone compounds, p-aminophenol compounds or ascorbic acid together with the above-described developing agents.

Examples of suitable solvents for silver halide include conventional fixing agents such as sodium thiosulfate, sodium thiocyanate, ammonium thiosulfate or compounds described in the above-described U.S. Pat. No. 2,543,181; and compounds composed of a combination of cyclic imide and nitrogen base such as those composed of a combination of barbiturate or uracil and ammonia or amine, or those composed of a combination described in U.S. Pat. No. 2,857,274 on Oct. 21, 1958 by Edwin H. Land et al.

Further, 1,1-bissulfonylalkane and derivatives thereof are known, which can be used as the solvent for silver halide in the present invention.

The processing compositions may contain alkalies and, preferably, alkali metal hydroxides such as sodium hydroxide or potassium hydroxide. In the case that the processing composition is applied as a thin layer between the light sensitive element and the image receiving element superposed on each other, it is preferred that the processing composition contain polymer film forming agents, thickening agents or viscosity increasing agents. Hydroxyethyl cellulose and sodium carboxymethyl cellulose are particularly useful for such a purpose, and are incorporated in the processing compositions in a concentration effective to give a suitable viscosity according to the known principle of the diffusion transfer process. The processing compositions may further contain other assistants known in silver transfer processes, for example, antifoggants, toning agents, and stabilizers, etc.

The image receiving element used in the present invention is composed of an image receiving layer containing a silver precipitant in a hydrophilic polymer binder and a support for supporting said layer, as described above.

As hydrophilic polymers, a number of materials have been known, but regenerated cellulose is particularly preferred, as described above. In order to produce the image receiving element, it is possible to utilize a process which comprises incorporating a silver precipitant in cellulose ester, for example, cellulose diacetate, by deposition, applying the cellulose ester to a support and hydrolyzing it with alkalies, a process which comprises forming a silver precipitant by reacting, for example, silver nitrate with sodium sulfide in a solution of cellulose ester, in situ, applying the solution to a support and hydrolyzing it with alkalies, a process which comprises hydrolyzing a cellulose ester layer applied previously to a support with alkalies, and putting a silver precipitant into the hydrolyzed layer at the same time, and a process which comprises hydrolyzing a cellulose ester layer with alkalies to form regenerated cellulose and forming a silver precipitant in the hydrolyzed layer by reacting, for example, chloroauric acid with a reducing agent.

Further, if necessary, it is possible to leave a layer of cellulose ester which is not hydrolyzed or partically hydrolyzed cellulose ester under a layer of hydrolyzed cellulose ester containing a silver precipitant, and it is possible to provide a polymer layer such as a polyvinyl butyral layer under a layer of hydrolyzed cellulose ester. The polymer layer is known to serve as a waterproof layer.

Further, if necessary, another hyrophilic polymer layer may be provided between the layer of hydrolyzed cellulose ester containing a silver precipitant and the waterproof layer composed of cellulose ester, partially hydrolyzed cellulose ester or polyvinylbutyral. Examples of polymers used for the hydrophilic polymer layer include gelatin, gelatin derivatives (for example, phthalated gelatin, etc.), saccharides (for example, starch, galactomannan, gum arabic, hydroxyethyl cellulose, methyl cellulose, carboxymethyl cellulose, pullulan, and hydroxypropyl cellulose, etc.), and hydrophilic synthetic polymers (for example, polyacrylamide, polymethyl acrylamide, poly-N-vinylpyrrolidone and 2-hydroxyethyl methacrylate, etc.), etc.

Further, if necessary, an alkali neutralizing agent layer may be provided. In this alkali neutralizing agent layer, polymer acids as described in Japanese Patent Publication No. 33697/73 are used.

Further, in order to improve the releasing property to processing solutions, it is effective to apply a layer of hydrophilic polymer, such as carboxymethyl cellulose, gelatin, gum arabic, dimethylhydantoin-formaldehyde condensation product or cellulose hydrogen acetate phthalate, etc., onto the image receiving layer.

Moreover, it is possible to add fluorescent whitening agents in order to improve whiteness, and it is effective to add plasticizers in order to further soften the polymer layer applied.

In the case of incorporating the image stabilizing agent of the present invention in the image receiving element, it is possible to add the image stabilizing agent to one or more of the above-described layers.

In particularly available embodiments, it has been found that it is advantageous to add the image stabilizing agent of the present invention to the layer containing a silver precipitant, namely, the layer of cellulose ester which is not subjected to hydrolysis under the image receiving layer, as described in U.S. Pat. No. 3,607,269, or to add the image stabilizing agent of the present invention to the layer of a hydrophilic high polymer such as 2-hydroxyethyl methacrylate provided under the hydrolyzed cellulose ester layer, as described in Japanese Patent Application (OPI) No. 120634/74. The amount thereof added to the layer of cellulose ester which is not subjected to hydrolysis, the layer of a hydrophilic high polymer or other layers is preferred to be in a range of from about $1\times10^{-6}$ to $1000\times10^{-6}$ mol/m$^2$. A particularly preferred amount is in the range of from $10\times10^{-6}$ to $500\times10^{-6}$ mol/m$^2$.

In order to incorporate the image stabilizing agent of the invention in the photographic element, it is possible to apply a solution which is prepared by dissolving the image stabilizing agent in water or a low boiling point organic solvent such as methanol, ethanol, propanol, acetone, methyl ethyl ketone, cyclohexanone, cyclopentanone, petroleum ether, benzene, toluene, ether, tetrahydrofuran, dioxane, dimethylformamide, ethyl acetate, or butyl acetate, etc., together with suitable polymers, or it is possible to immerse the photographic element in the solution of the image stabilizing agent after preparation of the photographic element.

Further, the image stabilizing agent can be added to the processing composition, whereby it diffuses into the image receiving element during processing to provide an image stabilizing effect.

Further, the compound used in the present invention may be used together with known image stabilizing agents. It is also effective to use the compound of the present invention together with heavy metal salts, for example, salts of noble metal such as gold, palladium, platinum or silver, etc., or metal salts such as zinc or nickel salt, etc. It is found that particularly useful heavy metal salts are soluble gold salts.

Examples of suitable silver precipitants include heavy metals such as iron, lead, zinc, nickel, cadmium, tin, chromium, copper, cobalt, and particularly, noble metals such as gold, silver, platinum, or palladium. Other examples of available silver precipitants include sulfides and selenides of heavy metals, and particularly sulfides of mercury, copper, aluminium, zinc, cadmium, cobalt, nickel, silver, palladium, lead, antimony, bismuth, and cerium, and selenides of lead, zinc, antimony and nickel. Functions of materials like silver precipitants in the silver transfer process have been described, e.g., in U.S. Pat. No. 2,774,667 by Edwin H. Land et al patented on Dec. 18, 1956.

The silver precipitant is present in a very small amount, for example, about $1\text{-}25\times10^{-5}$ mol/m$^2$, as in the known techniques. Generally, a lower amount as far as possible is used, because excess silver precipitates or undesirable density of background is formed on the highlight area if the amount is larger. A mixed silver precipitant may be used. It can be said that the image receiving layer is substantially colorless and substantially transparent so far as concerning presence of the precipitant.

In the following, the present invention is illustrated in greater detail with reference to examples and comparative examples.

EXAMPLE 1

(1) Preparation of image receiving elements (A):

To a polyethylene laminated paper wherein polyethylene was subjected to corona discharge treatment (area weight 150 g/m$^2$, thickness of polyethylene 20 $\mu$m), a solution prepared by dissolving 12 g of cellulose diacetate (degree of acetylation: 54%) and 8 g of methyl vinyl ether-maleic acid anhydride copolymer in 200 ml of acetone was applied. The amount of the polymers applied was 5 g/m$^2$.

To the resulting layer, a solution prepared by dissolving 20 g of cellulose diacetate in a mixture of 200 ml of acetone and 20 ml of methanol was applied. According to modification of the solution, the following image stabilizing agents were added. The amount of cellulose acetate applied was 4 g/m$^2$. The image stabilizing agents used are as follows.

| | | |
|---|---|---|
| Image receiving element A-1 | Compound 3 | (The present invention) |
| Image receiving element A-2 | Compound 4 | (The present invention) |
| Image receiving element A-3 | Compound 5 | (The present invention) |
| Image receiving element A-4 | Compound 16 | (The present invention) |
| Image receiving element A-5 | 1-Phenyl-5-mercaptotetrazole (Comparative example, compound described in Japanese Patent Publication No. 44418/81) | |
| Image receiving element A-6 | N—Methyl-mercaptoimidazole (Comparative example, compound described in Japanese Patent Publication No. 44418/81) | |
| Image receiving element A-7 | 2-Acetamido-5-mercapto-1,3,4-thiadiazole (Comparative example, compound described in Japanese Patent Publication No. 44418/81) | |
| Image receiving element A-8 | 1,6-Bis-(5-mercapto-1,3,4-thiadiazolyl-2-thio)hexane (Comparative example, compound described in Japanese Patent Publication No. 29417/80) | |
| Image receiving element A-9 | No image receiving agent (Comparative example) | |

These image stabilizing agents were applied after they were added in an amount of $1\times10^{-3}$ mol, respectively, to a solution of cellulose diacetate and dissolved therein.

To the resulting layer, a solution prepared by dissolving 10 g of cellulose diacetate and 5 mg of 1-phenyl-2-mercaptoimidazole in 200 ml of acetone was applied. 1-Phenyl-2-mercaptoimidazole used was toning agent. The amount of cellulose diacetate applied was 3 g/m$^2$.

To the polyethylene laminated paper containing a cellulose diacetate layer prepared as described above, the following alkaline hydrolyzing solution containing silver precipitants was applied in an amount of 30 ml/m$^2$ to produce image receiving sheets A-1 to A-9 for diffusion transfer process.

The alkaline hydrolyzing solution used was that prepared as described in the following.

0.7 g of nickel nitrate was dissolved in 7 ml of water, and 100 g of glycerine was added to the resulting solution. To the solution, a solution prepared by dissolving 5 g of sodium sulfide in 5 ml of water was added with vigorous stirring to produce a silver precipitant dispersion containing nickel sulfide.

To a solution prepared by dissolving 55 g of sodium hydroxide in a mixture of 300 ml of water and 1200 ml of methanol, 40 g of the above-described silver precipitant dispersion was added.

(2) Preparation of light-sensitive layer sheet:

A gelatin-dispersed silver iodobromide emulsion having an average particle size of 1.0 μm was prepared by the conventional process. 100 g thereof was removed in a pot and dissolved in a constant-temperature bath at 50° C. To the solution, 10 ml of a 1 wt.% aqueous solution of 3-{5-chloro-2-[2-ethyl-3-(3-ethyl-2-benzothiazolinylidene)-propenyl}-3-benzoxazolyl}propane sulfonate, 4-{2-(3-ethylbenzothiazolin-2-ylidene)-2-methyl-1-propenyl]-3-benzothiazolyl}propane sulfonate and 4-hydroxy-6-methyl-1,3,3a,7-tetrazaindene, 10 ml of a 1wt.% aqueous solution of 2-hydroxy-4,6-dichlorotriazine sodium salt and 10 ml of a 1 wt.% aqueous solution of sodium dodecylbenzene sulfonate were added, and the mixture was stirred. The resulting emulsion was applied to a polyethylene terephthalate film base having an undercoating layer containing titanium oxide so as to result in a dried film thickness of 5 microns, and dried to obtain a sample. The amount of silver applied was 1.0 g/m$^2$.

(3) Composition of processing solution:

| | |
|---|---|
| Potassium hydroxide (40% aqueous solution of KOH) | 323 ml |
| Titanium dioxide | 3 g |
| Hydroxyethyl cellulose | 79 g |
| Zinc oxide | 9.75 g |
| N,N—bis-methoxyethylhydroxylamine | 75 g |
| Solution of triethanolamine (4.5 parts of triethanolamine in 6.2 parts of water) | 17.14 g |
| Tetrahydropyrimidinethione | 0.4 g |
| 2,4-Dimercaptopyrimidine | 0.35 g |
| Uracil | 80 g |
| Water | 1193 g |

(4) Development processing and measurement of density:

The light-sensitive layer sheet was subjected to light-twedge exposure using a densitometer having a light source of a color temperature of 5400° K. The exposed light-sensitive layer sheet was laid on the image receiving sheet, the above-described processing solution was spread between both sheets so as to result a thickness of 0.05 mm to carry out diffusion transfer development. After being allowed to stand at 25° C. for 40 seconds, both sheets were separated to obtain a positive image.

It was measured by a TCD type self-recording densitometer produced by Fuji Photo Film Co. to determine a maximum density (Dmax).

(5) Forced deterioration test:

(a) Forced deterioration test of green sample:

After an undeveloped image receiving element was allowed to stand for 72 hours under a condition of 50° C. and 80% RH or a dry condition of 60° C., it was subjected to development processing in the same manner as in the above-described (4).

(b) Forced deterioration test of transfer image:

A transfer image obtained by the same development processing as in the above-described (4) was allowed to stand for 72 hours under a condition of 60° C. and 70% RH or 40° C. and 90% RH, fading thereof was evaluated.

(6) Result:

Image receiving elements A-1 to A-9 were examined. Results obtained are shown together in Table 1.

In this table, a tone of the transfer image just after development processing and that after the forced deterioration test at 60° C. and 70% RH for 3 days are shown.

TABLE 1

| Image receiving element | Maximum density (Dmax) | | | | | Tone of transfer image | |
|---|---|---|---|---|---|---|---|
| | Just after development processing | Forced passage of time for green sample | | Forced deterioration of transfer image | | Just after development processing | After fading test at 60° C., 70% RH for 3 days |
| | | 50° C., 80% RH | 60° C., dry | 60° C., 70% RH | 40° C., 90% RH | | |
| A-1 | 1.58 | 1.52 | 1.56 | 1.45 | 1.52 | Neutral gray | Neutral gray |
| A-2 | 1.61 | 1.57 | 1.60 | 1.45 | 1.49 | " | " |
| A-3 | 1.60 | 1.55 | 1.61 | 1.46 | 1.50 | " | " |
| A-4 | 1.63 | 1.60 | 1.61 | 1.44 | 1.53 | " | " |
| A-5 | 1.42 | 0.93 | 1.27 | 1.17 | 1.29 | " | Brown |
| A-6 | 1.48 | 1.02 | 1.37 | 1.25 | 1.30 | " | Blackish brown |
| A-7 | 1.50 | 1.33 | 1.40 | 1.28 | 1.35 | " | Yellowish brown |
| A-8 | 1.53 | 1.42 | 1.46 | 1.25 | 1.33 | " | " |
| A-9 | 1.65 | 1.60 | 1.64 | 1.24 | 1.31 | Blackish brown | " |

It is obvious that, in image receiving elements A-1, A-2, A-3, and A-4 using the compounds of the present invention, the maximum density just after processing is high, reduction of the maximum density of images by the forced deterioration test is small, discoloration of images does not substantially occur, and reduction of the maximum density by the forced passage test of green samples is small, as compared with comparative image receiving elements A-5, A-6, A-7, and A-8. Namely, it is obvious that the compounds of the present invention are superior.

In comparative samples A-5, A-6, A-7, and A-8, though the image stabilizating effect is observed as compared with the blank sample A-9 containing no image stabilizing agent, the effect is insufficient.

EXAMPLE 2

(1) Preparation of image receiving elements (B):

To the same polyethylene laminated paper as in Example 1, a solution prepared by dissolving 20 g of cellulose triacetate (degree of acetylation: 61%) in a mixed solvent composed of 100 ml of dichloromethane, 40 ml of ethylene chloride, 40 ml of tetrachloroethane and 20 ml of methanol was applied. The amount of cellulose triacetate applied was 5 g/m$^2$.

To the resulting cellulose triacetate layer, a solution prepared by dissolving 20 g of homopolymer of 2-hydroxyethyl methacrylate in a mixture of 200 ml of acetone and 300 ml of water was applied so as to result in a dried film thickness of 3 μm. To the above-described coating solution, the following image stabilizing agents were added.

The image stabilizing agents used were as follows.

| | | |
|---|---|---|
| Image receiving element B-1 | Compound 1 | (The present invention) |
| Image receiving element B-2 | Compound 3 | (The present invention) |
| Image receiving element B-3 | Compound 6 | (The present invention) |
| Image receiving element B-4 | Compound 18 | (The present invention) |
| Image receiving element B-5 | Compound 20 | (The present invention) |
| Image receiving element B-6 | 2-Imidazolidinethione (Comparative example, Japanese Patent Application (OPI) No. 120632/74) | |
| Image receiving element B-7 | 1-Methyl-2-mercaptoimidazole (Comparative example, Japanese Patent Application (OPI) No. 120632/74) | |
| Image receiving element B-8 | 4-Phenyl-3-mercapto-1,2,4-triazole (Comparative example, Japanese Patent Application (OPI) No. 120632/74) | |
| Image receiving element B-9 | 6-Bromobenzimidazole (Comparative example, Japanese Patent Application (OPI) No. 120632/74) | |
| Image receiving element B-10 | No addition (Blank) | (Comparative example) |

These image stabilizing agents were added, respectively, in a state of solution in acetone in an amount of $1\times10^{-3}$ mol/l to a solution of homopolymer of 2-hydroxyethyl methacrylate, and they were then applied.

To a layer of homopolymer of 2-hydroxyethyl methacrylate formed as described above, a cellulose triacetate layer containing 1-phenyl-2-mercaptoimidazole was applied so as to result in a dried film thickness of 3 μm.

The coated materials prepared as described above were immersed in an alkaline hydrolyzing solution containing the following silver precipitant at 40° C. for 1 hour. After they were washed with flowing water for 2 minutes, they were dried to produce image receiving sheets B-1 to B-10 for diffusion transfer process.

Firstly, 0.1 g of nickel nitrate was dissolved in 1 ml of water, and the resulting solution was added to 100 ml of glycerine. To the resulting solution, a solution prepared by dissolving 1 g of sodium sulfide in 2 ml of water was added with vigorously stirring to produce a silver precipitant dispersion of nickel sulfide.

10 ml of the above-described nickel sulfide dispersion was added to a solution prepared by dissolving 80 g of sodium hydroxide in a mixture of 400 ml of water and 600 ml of methanol.

(2) Testing condition:

Using the same light-sensitive element and the same processing solution as in Example 1, tests were carried out by the same manner as in Example 1.

(3) Result:

Results of tests obtained using the image receiving elements B-1 to B-10 are shown together in Table 2.

TABLE 2

| Image receiving element | Maximum density (Dmax) | | | | | Tone of transfer image | |
|---|---|---|---|---|---|---|---|
| | Just after development processing | Forced passage of time for green sample | | Forced deterioration of transfer image | | Just after development processing | After fading test at 60° C., 70% RH for 3 days |
| | | 50° C., 80% RH | 60° C., dry | 60° C., 70% RH | 40° C., 90% RH | | |
| B-1 | 1.45 | 1.40 | 1.43 | 1.37 | 1.36 | Neutral gray | Neutral gray |
| B-2 | 1.47 | 1.42 | 1.46 | 1.35 | 1.40 | " | " |
| B-3 | 1.46 | 1.44 | 1.47 | 1.38 | 1.39 | " | " |
| B-4 | 1.45 | 1.41 | 1.41 | 1.34 | 1.36 | " | " |
| B-5 | 1.47 | 1.45 | 1.43 | 1.34 | 1.37 | " | " |
| B-6 (Comparative example) | 1.21 | 0.87 | 1.15 | 1.07 | 1.05 | " | " |
| B-7 (Comparative example) | 1.20 | 0.90 | 1.03 | 1.00 | 1.02 | " | Blackish brown |
| B-8 (Comparative example) | 1.33 | 1.20 | 1.27 | 1.13 | 1.17 | " | Brown |
| B-9 (Comparative example) | 1.43 | 1.35 | 1.40 | 1.24 | 1.23 | " | Yellowish brown |
| B-10 (Comparative example) | 1.50 | 1.47 | 1.51 | 1.13 | 1.21 | " | " |

It is clear that in the image receiving elements B-1 to B-5 using the compounds of the present invention, reduction of the maximum density of the image by the forced deterioration test was small and reduction of the maximum density by the forced passage test of green samples was small, as compared with the comparative samples B-6 to B-9. Namely, it is obvious that the compounds of the present invention are superior.

In the sample B-10 which did not contain the image stabilizing agent, the tone of the original silver image was not neutral gray, and reduction of the maximum density by the image fading test was large.

EXAMPLE 3

(1) Preparation of image receiving elements (C):

To the same support as that used in Example 1, a solution prepared by dissolving 20 g of methyl vinyl ether-monobutyl maleate copolymer in 200 ml of acetone was applied so as to result in a dried film thickness of 5 μm. To the above-described solution, the following image stabilizing agents were added.

Image stabilizing agents used were as follows.

| | | |
|---|---|---|
| Image receiving | Compound 2 | (The present invention) |

-continued

| | | |
|---|---|---|
| element C-1 | | |
| Image receiving element C-2 | Compound 3 | (The present invention) |
| Image receiving element C-3 | Compound 24 | (The present invention) |
| Image receiving element C-4 | Compound 4 | (The present invention) |
| Image receiving element C-5 | Compound 16 | (The present invention) |
| Image receiving element C-6 | 1-Phenyl-2-mercaptoimidazole (Comparative example, Japanese Patent Application (OPI) No. 120634/74) | |
| Image receiving element C-7 | No addition | (Comparative example) |

To the resulting layer, a solution prepared by dissolving 20 g of cellulose diacetate and 5 mg of 1-phenyl-2-mercaptoimidazole in a mixture of 180 ml of acetone and 20 ml of methanol was applied. The dried thickness was 6 μm.

To the polyethylene laminated paper containing a cellulose diacetate layer prepared as described above, an alkaline hydrolyzing solution containing a nickel sulfide silver-precipitant was applied in the same manner as in Example 1 to produce image receiving elements.

(2) Testing condition:

Tests were carried out in the same manner as in Example 1 using the same light-sensitive element and the same processing solution as in Example 1.

(3) Result:

Results obtained are shown together in Table 3.

It is obvious that, in the image receiving elements using the compounds of the present invention, reduction of the maximum density by the forced passage test of green samples is small and stability of images is high, as compared with comparative examples.

TABLE 3

| Image receiving element | Maximum density (Dmax) | | | | | Tone of transfer image | |
|---|---|---|---|---|---|---|---|
| | Just after development processing | Forced passage of time for green sample | | Forced deterioration of transfer image | | Just after development processing | After fading test at 60° C. 70% RH for 3 days |
| | | 50° C., 80% RH | 60° C., dry | 60° C., 70% RH | 40° C., 90% RH | | |
| C-1 | 1.60 | 1.55 | 1.57 | 1.43 | 1.45 | Neutral gray | Neutral gray |
| C-2 | 1.61 | 1.55 | 1.57 | 1.42 | 1.45 | " | " |
| C-3 | 1.59 | 1.57 | 1.56 | 1.40 | 1.42 | " | " |
| C-4 | 1.62 | 1.59 | 1.58 | 1.45 | 1.48 | " | " |
| C-5 | 1.63 | 1.60 | 1.56 | 1.46 | 1.50 | " | " |
| C-6 (Comparative example) | 1.55 | 1.31 | 1.43 | 1.32 | 1.35 | " | " |
| C-7 (Comparative example) | 1.68 | 1.65 | 1.65 | 1.31 | 1.35 | Blackish brown | Yellowish brown |

EXAMPLE 4

(1) Preparation of image receiving elements (D):

To a polyethylene laminated paper, a solution prepared by dissolving 10 g of cellulose diacetate and 10 g of methyl vinyl ether-maleic acid anhydride copolymer in 200 ml of acetone was applied so as to result in a dried film thickness of 5 μm.

To the resulting layer, a solution prepared by dissolving 20 g of cellulose diacetate in a mixture of 200 ml of acetone and 20 ml of methanol was applied. To the above-described solution, the following image stabilizing agents were added. The amount of cellulose diacetate applied was 4 g/m$^2$.

Image stabilizing agents used were as follows.

| | | |
|---|---|---|
| Image receiving element D-1 | Compound 3 | (The present invention) |
| Image receiving element D-2 | Compound 5 | (The present invention) |
| Image receiving element D-3 | Compound 7 | (The present invention) |
| Image receiving element D-4 | Compound 15 | (The present invention) |
| Image receiving element D-5 | Compound 17 | (The present invention) |
| Image receiving element D-6 | Compound 21 | (The present invention) |
| Image receiving element D-7 | 2-Acetamido-5-mercapto-1,3,4-thiadiazole (Comparative example, Japanese Patent Publication No. 44418/81) | |
| Image receiving element D-8 | Imidazolidinethione (Comparative example, Japanese Patent Publication No. 44418/81) | |
| Image receiving element D-9 | 1,6-Bis(5-mercapto-1,3,4-thiadiazolyl-2-thio)hexane (Comparative example, Japanese Patent Publication No. 29417/80) | |
| Image receiving element D-10 | No addition | (Comparative example) |

To the resulting cellulose diacetate layer, a solution of cellulose diacetate containing palladium sulfide prepared as described below, to which 1-phenyl-2-mercaptoimidazole was added as a toning agent, was applied so as to result in a dried film thickness of 2 μm.

The solution of cellulose diacetate containing palladium sulfide was produced as follows.

To a solution prepared by dissolving 10 g of cellulose diacetate (degree of acetylation: 54%) in a mixture of 160 ml of acetone and 20 ml methanol, a solution prepared by dissolving 0.024 g of sodium sulfide ($9H_2O$) in 10 ml of methanol and a solution prepared by dissolving 0.03 g of sodium chloropalladate in a mixture of 3 ml of water and 7 ml of methanol were added with vigorously stirred.

To the resulting cellulose diacetate layer containing palladium sulfide, an alkaline hydrolyzing solution prepared by dissolving 40 g of KOH in a mixture of 200 ml of water and 800 ml of methanol was applied to form a regenerated cellulose layer containing palladium sulfide.

(2) Testing condition:

Properties of the image receiving elements D-1 to D-10 obtained as described above were tested by the same manner as in Example 1.

(3) Result:

Results obtained are shown together in Table 4.

It is obvious that the image receiving elements using the compounds of the present invention are excellent in image stabilizing property and stability of green samples to the passage of time.

TABLE 4

| Image receiving element | Maximum density (Dmax) | | | | | Tone of transfer image | |
|---|---|---|---|---|---|---|---|
| | Just after development processing | Forced passage of time for green sample | | Forced deterioration of transfer image | | Just after development processing | After fading test at 60° C., 70% RH for 3 days |
| | | 50° C., 80% RH | 60° C., dry | 60° C., 70% RH | 40° C., 90% RH | | |
| D-1 | 1.54 | 1.48 | 1.55 | 1.40 | 1.41 | Neutral gray | Neutral gray |
| D-2 | 1.55 | 1.50 | 1.52 | 1.39 | 1.44 | " | " |
| D-3 | 1.56 | 1.51 | 1.53 | 1.42 | 1.45 | " | " |
| D-4 | 1.55 | 1.49 | 1.50 | 1.41 | 1.47 | " | " |
| D-5 | 1.54 | 1.50 | 1.50 | 1.40 | 1.44 | " | " |
| D-6 | 1.57 | 1.52 | 1.53 | 1.39 | 1.45 | " | " |
| D-7 (Comparative example) | 1.35 | 1.21 | 1.24 | 1.07 | 1.12 | " | Brown |
| D-8 (Comparative example) | 1.31 | 1.03 | 1.21 | 1.11 | 1.17 | " | Blackish brown |
| D-9 (Comparative example) | 1.48 | 1.35 | 1.40 | 1.25 | 1.20 | " | Brown |
| D-10 (Comparative example) | 1.58 | 1.55 | 1.56 | 1.13 | 1.10 | " | Yellowish brown |

EXAMPLE 5

(1) Preparation of image receiving elements (E)

On a polyethylene laminated paper, a layer of a mixture of cellulose diacetate and methyl vinyl ether/-maleic acid anhydride copolymer was provided, and thereafter a layer of cellulose diacetate containing the image stabilizing agent as described in the following was provided in the same manner as in Example 4.

Imager stabilizing agents used were as follows.

| | | |
|---|---|---|
| Image receiving layer E-1 | Compound 1 | (The present invention) |
| Image receiving layer E-2 | Compound 2 | (The present invention) |
| Image receiving layer E-3 | Compound 3 | (The present invention) |
| Image receiving layer E-4 | Compound 24 | (The present invention) |
| Image receiving layer E-5 | Compound 4 | (The present invention) |
| Image receiving layer E-6 | 1-Phenyl-2-mercaptoimidazole | (Comparative example) |
| Image receiving layer E-7 | No addition | (Comparative example) |

To the resulting layer, a solution prepared by dissolving 10 g of gum arabic in a mixture of 100 ml of water and 100 ml of methanol was applied so as to result in a dried film thickness of 1 μm and, thereafter, cellulose diacetate was applied so as to result in a dried film thickness of 2 μm.

To the resulting coated materials, the same alkaline hydrolyzing solution containing nickel sulfide as that used in Example 1 was applied to prepare image receiving elements E-1 to E-7.

(2) Method of testing and result:

Tests were carried out in the same manner as in Example 1 using the same light-sensitive element and the same processing solution as those used in Example 1.

Results are shown together in Table 5.

It is obvious that the image receiving elements using the compounds of the present invention have high stability of images and excellent stability of samples wi-threspect to the passage of time.

TABLE 5

| Image receiving element | Maximum density (Dmax) | | | | | Tone of transfer image | |
|---|---|---|---|---|---|---|---|
| | Just after development processing | Forced passage of time for green sample | | Forced deterioration of transfer image | | Just after development processing | After fading test at 60° C., 70% RH for 3 days |
| | | 50° C., 80% RH | 60° C., dry | 60° C., 70% RH | 40° C., 90% RH | | |
| E-1 | 1.65 | 1.61 | 1.66 | 1.48 | 1.56 | Neutral gray | Neutral gray |
| E-2 | 1.66 | 1.63 | 1.65 | 1.50 | 1.55 | " | " |
| E-3 | 1.68 | 1.62 | 1.67 | 1.47 | 1.56 | " | " |
| E-4 | 1.67 | 1.65 | 1.68 | 1.49 | 1.55 | " | " |
| E-5 | 1.67 | 1.64 | 1.65 | 1.47 | 1.57 | " | " |
| E-6 (Comparative example) | 1.54 | 1.21 | 1.36 | 1.30 | 1.38 | " | Blackish brown |
| E-7 (Comparative example) | 1.74 | 1.71 | 1.73 | 1.23 | 1.20 | " | Yellowish brown |

EXAMPLE 6

(1) Production of image receiving elements (F):

A layer containing cellulose diacetate and methyl vinyl ether-maleic acid anhydride copolymer was produced in the same manner as in Example 5.

On the resulting layer, a layer of cellulose diacetate containing an image stabilizing agent was provided to produce image receiving elements F-1 to F-7. The image stabilizing agents used were the same as those used in E-1 to E-7 in Example 5.

On the resulting layer, a layer of gum arabic was formed in the same manner as in Example 5, and, further, the same solution of cellulose diacetate containing palladium sulfide as that used in Example 4, to which 1-phenyl-2-mercaptoimidazole was added, was applied so as to result in a dried film thickness of 1 μm.

To the coating materials prepared as described above, the same alkaline hydrolyzing solution as that used in Example 4 was applied so as to change the top layer into regenerated cellulose layer to produce image receiving elements F-1 to F-7.

(2) Method of testing and result:

Tests were carried out by the same manner as in Example 5.

Results are shown together in Table 6.

It is obvious that the compounds of the present invention show a great effect of image stabilization and they are excellent in the stability of the samples with respect to the passage of time.

TABLE 6

| Image receiving element | Maximum density (Dmax) Just after development processing | Forced passage of time for green sample 50° C., 80% RH | 60° C., dry | Forced deterioration of transfer image 60° C., 70% RH | 40° C., 90% RH | Tone of transfer image Just after development processing | After fading test at 60° C., 70% RH for 3 days |
|---|---|---|---|---|---|---|---|
| F-1 | 1.70 | 1.65 | 1.67 | 1.50 | 1.57 | Neutral gray | Neutral gray |
| F-2 | 1.69 | 1.66 | 1.66 | 1.51 | 1.56 | " | " |
| F-3 | 1.71 | 1.66 | 1.70 | 1.49 | 1.58 | " | " |
| F-4 | 1.70 | 1.67 | 1.68 | 1.52 | 1.55 | " | " |
| F-5 | 1.68 | 1.65 | 1.65 | 1.50 | 1.53 | " | " |
| F-6 (Comparative example) | 1.55 | 1.24 | 1.44 | 1.38 | 1.42 | " | Blackish brown |
| F-7 (Comparative example) | 1.75 | 1.71 | 1.73 | 1.20 | 1.22 | " | Yellowish brown |

EXAMPLE 7

Image receiving elements were produced and tested in the same manner as in Example 6, except that polyacrylamide was used in place of gum arabic.

The resulting image receiving elements using the compounds of the present invention were excellent in preservation property as in the case of Example 6, and fading of images was small.

EXAMPLE 8

(1) Production of image receiving elements (G):

A layer containing cellulose diacetate and methyl vinyl ether-maleic acid anhydride copolymer was produced in the same manner as in Example 6.

On the resulting layer, a layer of cellulose diacetate was formed so as to result in a dried film thickness of 4 μm.

On the resulting layer, a layer of gum arabic containing the image stabilizing agent and the heavy metal salt was provided.

The image stabilizing agents and heavy metal salts used were as follows.

| | | |
|---|---|---|
| Image receiving element G-1 | Compound 3 No heavy metal salt | (The present invention) |
| Image receiving element G-2 | Compound 3 Chloroaurate | (The present invention) |
| Image receiving element G-3 | Compound 3 Zinc acetate | (The present invention) |
| Image receiving element G-4 | 1-Phenyl-2-mercapto-imidazole. No heavy metal salt | (Comparative example) |
| Image receiving element G-5 | 1-Phenyl-2-mercapto-imidazole. Chloroaurate | (Comparative example) |
| Image receiving element G-6 | 1-Phenyl-2-mercapto-imidazole Zinc acetate | (Comparative example) |
| Image receiving element G-7 | No addition | (Comparative example) |

To the resulting layer, the same solution of cellulose diacetate containing palladium sulfide and the same alkaline hydrolyzing solution as those used in Example 6 were applied in turn to produce image receiving elements G-1 to G-7.

(2) Method of testing and result

Tests were carried out by the same manner as in Example 5.

Results are shown together in Table 7.

It is obvious that the image receiving elements using the compounds of the present invention are excellent in preservation property of the inventive samples as compared with those of comparative examples.

Further, in the case of using heavy metal salts, particularly chloroaurate together with the compounds of the present invention, stability of the images to the passage of time is particularly excellent.

TABLE 7

| Image receiving element | Maximum density (Dmax) Just after development processing | Forced passage of time for green sample 50° C., 80% RH | 60° C., dry | Forced deterioration of transfer image 60° C., 70% RH | 40° C., 90% RH | Tone of transfer image Just after development processing | After fading test at 60° C., 70% RH for 3 days |
|---|---|---|---|---|---|---|---|
| G-1 | 1.58 | 1.54 | 1.57 | 1.39 | 1.46 | Neutral gray | Neutral gray |
| G-2 | 1.64 | 1.67 | 1.65 | 1.50 | 1.56 | " | " |
| G-3 | 1.60 | 1.59 | 1.61 | 1.43 | 1.50 | " | " |
| G-4 (Comparative example) | 1.45 | 1.18 | 1.38 | 1.26 | 1.30 | " | Blackish brown |
| G-5 (Comparative example) | 1.50 | 1.30 | 1.46 | 1.34 | 1.40 | " | Neutral gray |

TABLE 7-continued

| Image receiving element | Maximum density (Dmax) | | | | | Tone of transfer image | |
|---|---|---|---|---|---|---|---|
| | Just after development processing | Forced passage of time for green sample | | Forced deterioration of transfer image | | Just after development processing | After fading test at 60° C., 70% RH for 3 days |
| | | 50° C., 80% RH | 60° C., dry | 60° C., 70% RH | 40° C., 90% RH | | |
| G-6 (Comparative example) | 1.46 | 1.27 | 1.40 | 1.29 | 1.35 | " | Blackish brown |
| G-7 (Comparative example) | 1.70 | 1.69 | 1.67 | 1.17 | 1.19 | " | Yellowish brown |

In the following, preferred embodiments of the invention are described:

1. An embodiment wherein, the compound represented by the formula (I) is

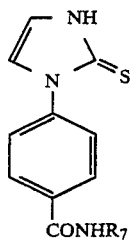

wherein $R_7$ represents an alkyl group having 4 to 14 carbon atoms or a substituted alkyl group having 4 to 14 carbon atoms in the alkyl moiety.

2. An embodiment of embodiment 1 wherein $R_7$ is a butyl group, a pentyl group, a hexyl group, a heptyl group, an octyl group, a decyl group, or a dodecyl group.

3. An embodiment wherein, the compound represented by the formula (II) is

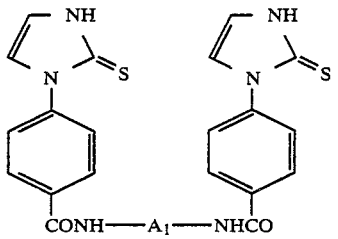

wherein $A_1$ represents an alkylene group having 2 to 8 carbon atoms.

4. An embodiment of embodiment 3 wherein $A_1$ is an ethylene group, a propylene group, a butylene group, a pentylene group, a heptylene group or an octylene group.

5. An embodiment wherein, the photographic element for silver salt diffusion transfer process is characterized in that the compound represented by formula (I) or (II) is contained in the image receiving element.

6. An embodiment of embodiment 1 wherein the image receiving element contains an image receiving layer containing a silver precipitant.

7. An embodiment of embodiment 6 wherein the binder in the image receiving layer is regenerated cellulose.

8. An embodiment of embodiment 6 wherein the compound represented by the formula (I) or (II) is added to a layer under the image receiving layer of the image receiving element.

9. An embodiment of embodiment 8 wherein the binder in the layer containing the compound represented by the formula (I) or (II) of the image receiving element contains polymer of 2-hydroxyethyl methacrylate.

10. An embodiment of embodiment 6 wherein the image receiving element contains a layer of acid polymer.

11. An embodiment of embodiment 10 wherein the compound represented by the formula (I) or (II) is contained in the layer of acid polymer of the image receiving element.

12. An embodiment of embodiment 5 wherein the compound represented by the formula (I) or (II) is contained in the layer containing a silver precipitant of the image receiving element.

13. An embodiment of embodiment 5 wherein the compound represented by the formula (I) or (II) in the image receiving element is

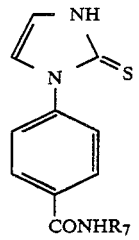

wherein $R_7$ represents an alkyl group having 4 to 14 carbon atoms or a substituted alkyl group having 4 to 14 carbon atoms in the alkyl moiety.

14. An embodiment of embodiment 13 wherein $R_7$ is a butyl group, a pentyl group, a hexyl group, a heptyl group, an octyl group, a decyl group or a dodecyl group.

15. An embodiment of embodiment 5 wherein the compound represented by the formula (II) in the image receiving element is

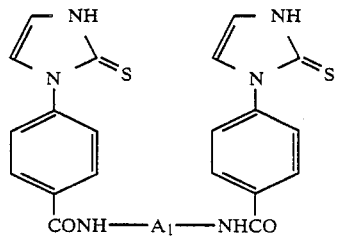

wherein $A_1$ represents an alkylene group having 2 to 8 carbon atoms.

16. An embodiment of embodiment 15 wherein $A_1$ is an ethylene group, a propylene group, a butylene group, a pentylene group, a heptylene group, or an octylene group.

17. An embodiment wherein, the photographic element for silver salt diffusion transfer process is characterized in that transfer silver images are obtained by laying a light-sensitive material, wherein a light-sensitive element containing a silver halide photographic emulsion is applied to a support, on an image receiving material wherein an image receiving element containing silver precipitants is applied to another support, and spreading an alkali processing composition as the processing element between the light-sensitive material and the image receiving material.

18. An embodiment of embodiment 17 wherein the support of the image receiving element is polyethylene laminated paper.

19. An embodiment wherein, the image receiving element has a layer for controlling timing of neutralization so as to reduce the pH of the image receiving element after the development processing.

20. An embodiment of embodiment 19 wherein the neutralization timing layer contains acetyl cellulose.

21. An embodiment of embodiment 17 wherein the layer construction of the image receiving element comprises, in the order listed, an acid polymer layer, a neutralization timing layer, and an image receiving layer containing silver precipitants, which are provided on a support.

22. An embodiment of embodiment 17 wherein the layer construction of the image receiving element consists of, in the order listed, an acid polymer layer, a neutralization timing layer, a hydrophilic polymer layer, and an image receiving layer containing silver precipitants, which are provided on a support.

23. Embodiments of embodiments 21 and 22, the compound represented by the formulae (I) and (II) is added to both the image receiving layer and another layer.

24. An embodiment of embodiment 5 wherein the image receiving element contains the compound represented by formula (I) or (II) and a water soluble heavy metal salt.

25. In embodiment 24, the heavy metal salt is chloroaurate.

While the invention has been described in detail and with reference to specific embodiment thereof, it will be apparent to one skilled in the art that various changes and modifications can be made therein without departing from the spirit and scope thereof.

What is claimed is:

1. In a photographic element for a silver salt diffusion transfer process comprising a silver halide light-sensitive element, an image receiving element and a processing element, the improvement wherein said photographic element contains a compound represented by formula (I) or (II)

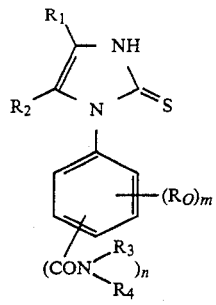

(I)

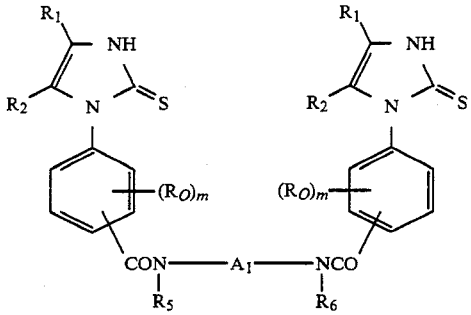

(II)

wherein the $R_0$s, which may be identical or different from one another, each represents hydrogen, a halogen atom, an alkyl group, a substituted alkyl group, a substituted or unsubstituted cycloalkyl group, an alkoxy group, a substituted alkoxy group, a substituted or unsubstituted alkylsulfonyl group, a substituted or unsubstituted arylsulfonyl group, a sulfamoyl group, an alkyl or arylsulfonamido group, a carbamoyl group, a carbonamido group, a heterocyclic group, a substituted or unsubstituted aryl group, an acyl group, a substituted or unsubstituted alkoxycarbonyl group, a substituted or unsubstituted acyloxy group, a substituted or unsubstituted alkylthio group, a substituted or unsubstituted arylthio group, a primary amino group or the salt thereof, a secondary or tertiary amino group substituted by alkyl groups or aryl groups or the salt thereof, a nitro group, a hydroxyl group, a carboxyl group, a sulfonic acid group or a cyano group; $R_1$ and $R_2$ each represents hydrogen, an alkyl group, a substituted alkyl group or an aryl group; $R_3$ and $R_4$ each represents hydrogen, an alkyl group, a substituted alkyl group, an aryl group, a substituted aryl group or a heterocyclic group; $R_3$ and $R_4$ may form a 5- or 6-membered ring together with the nitrogen atom, wherein the ring may further contain hetero atoms; $R_5$ and $R_6$ each represents hydrogen, an alkyl group, a substituted alkyl group, an aryl group, a substituted aryl group or a heterocyclic group; $A_1$ represents a divalent group; m represents an integer of 1 to 4; and n represents 1 or 2.

2. A photographic element as in claim 1, wherein the concentration of the compound represented by formula (I) or (II) is in the range of from about $1\times10^{-6}$ to $1000\times10^{-6}$ mol/m$^2$.

3. A photographic element as in claim 1, wherein the concentration of the compound represented by formula (I) or (II) is in the range of from $10\times10^{-6}$ to $500\times10^{-6}$ mol/m$^2$.

4. A photographic element as in claim 1, wherein the compound represented by formula (I) is

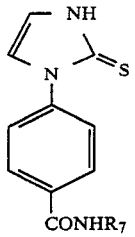

wherein $R_7$ represents an alkyl group having 4 to 14 carbon atoms or a substituted alkyl group having 4 to 14 carbon atoms in the alkyl moiety.

5. A photographic element as in claim 4, wherein $R_7$ is a butyl group, a pentyl group, a hexyl group, a heptyl group, an octyl group, a decyl group, or a dodecyl group.

6. A photographic element as in claim 1 wherein the compound represented by the formula (II) is

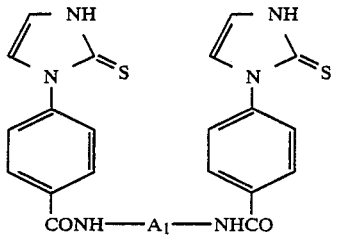

wherein $A_1$ represents an alkylene group having 2 to 8 carbon atoms.

7. A photographic element as in claim 5, wherein $A_1$ is an ethylene group, a propylene group, a butylene group, a pentylene group, a heptylene group or an octylene group.

8. A photographic element is in claim 4, wherein the image receiving element contains an image receiving layer containing a silver precipitant.

9. A photographic element as in claim 8, wherein the binder in the image receiving layer is regenerated cellulose.

10. A photographic element as in claim 1, wherein the compound represented by formula (I) or (II) is contained in the image receiving element.

11. A photographic element as in claim 10, wherein the compound represented by formula (I) or (II) is contained in a layer containing a silver precipitant of the image receiving element.

12. A photographic element as in claim 10, wherein the compound represented by formula (I) or (II) in the image receiving element is

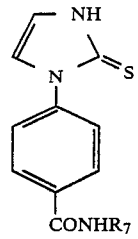

wherein $R_7$ represents an alkyl group having 4 to 14 carbon atoms or a substituted alkyl group having 4 to 14 carbon atoms in the alkyl moiety.

13. A photographic element as in claim 12, wherein $R_7$ is a butyl group, a pentyl group, a hexyl group, a heptyl group, an octyl group, a decyl group, or a dodecyl group.

14. A photographic element as in claim 10, wherein the compound represented by formula (I) in the image receiving element is

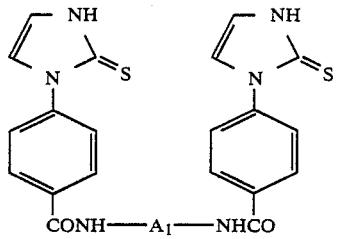

wherein $A_1$ represents an alkylene group having 2 to 8 carbon atoms.

15. A photographic element as in claim 14, wherein $A_1$ is an ethylene group, a propylene group, a butylene group, a pentylene group, a heptylene group, or an octylene group.

16. A photographic element as in claim 1, wherein transfer silver images are obtained by preparing the element by laying a light-sensitive material, wherein a light-sensitive element containing a silver halide photographic emulsion is applied to a support, on an image receiving material wherein an image receiving element containing silver precipitants is applied to another support, and spreading an alkali processing composition as the processing element between the light-sensitive material and the image receiving material.

17. A photographic element as in claim 16, wherein the layer construction of the image receiving element comprises, in the order listed, an acid polymer layer, a neutralization timing layer, and an image receiving layer containing silver precipitants, which are provided on a support.

18. A photographic element as in claim 16, wherein the layer construction of the image receiving element consists of, in the order listed, an acid polymer layer, a neutralization timing layer, a hydrophilic polymer layer, and an image receiving layer containing silver precipitants, which are provided on a support.

19. A photographic element as in claim 10, wherein the image receiving element contains the compound represented by formula (I) or (II) and a water soluble heavy metal salt.

20. A photographic element as in claim 19, wherein the heavy metal salt is chloroaurate.

* * * * *